US005344079A

United States Patent [19]

Tasaki et al.

[11] Patent Number: 5,344,079

[45] Date of Patent: Sep. 6, 1994

[54] FOAMING NOZZLE FOR SPRAYER

[75] Inventors: Takaharu Tasaki; Tadao Saito, both of Tokyo, Japan

[73] Assignee: Yoshino Kogyosho Co., Ltd., Tokyo, Japan

[21] Appl. No.: 858,973

[22] Filed: May 20, 1992

[30] Foreign Application Priority Data

| | | | |
|---|---|---|---|
| Oct. 12, 1990 | [JP] | Japan | 2-107050[U] |
| Nov. 5, 1990 | [JP] | Japan | 2-116345[U] |
| Nov. 5, 1990 | [JP] | Japan | 2-116346[U] |
| May 21, 1991 | [JP] | Japan | 3-145380 |
| Jun. 5, 1991 | [JP] | Japan | 3-162215 |

[51] Int. Cl.[5] ..... B05B 1/26

[52] U.S. Cl. ..... 239/498; 239/499; 239/504; 239/518

[58] Field of Search ..... 239/498, 499, 502, 504, 239/505, 506, 507, 512, 515, 518, 343, 333, 288, 288.5

[56] References Cited

U.S. PATENT DOCUMENTS

| | | | |
|---|---|---|---|
| 2,747,931 | 5/1956 | Wilson | 239/505 |
| 2,815,983 | 12/1957 | Hunter | 239/515 |
| 3,369,756 | 2/1968 | Ramis | 239/499 |
| 3,935,974 | 2/1976 | Weyn | 239/288.5 |
| 3,935,999 | 2/1976 | Weyn | 239/288.5 |
| 4,646,973 | 3/1987 | Focaracci . | |
| 4,779,803 | 10/1988 | Corsette | 239/512 |
| 4,883,227 | 11/1989 | Maas | 239/343 |
| 4,925,106 | 5/1990 | Maas et al. | 239/504 |
| 4,944,460 | 7/1990 | Steingass . | |
| 4,971,252 | 11/1990 | Tasaki et al. | 239/343 |
| 5,255,848 | 10/1993 | Rhodehouse | 239/288.5 |

FOREIGN PATENT DOCUMENTS

| | | |
|---|---|---|
| 1816945 | 6/1970 | Fed. Rep. of Germany . |
| 54-181011 | 12/1979 | Japan . |
| 62-31950 | 2/1987 | Japan . |
| 63-69579 | 5/1988 | Japan . |

*Primary Examiner*—Andres Kashnikow
*Assistant Examiner*—Christopher G. Trainor
*Attorney, Agent, or Firm*—Oliff & Berridge

[57] ABSTRACT

A foaming nozzle mounted in front of a spray nozzle of a sprayer so that a liquid detergent may be sprayed in a foamed state onto a window glass or tile for cleaning. The foaming nozzle has its mouth shaped so that a mixed cluster of the mist and foam from the foaming nozzle is injected in a band, elliptical, rectangular or triangular shape and at a wide angle. A predetermined relationship between a spray port and the foaming nozzle allows the mist spin-injected at a high swirling speed to be partially mixed with the foam. The foam is formed by the impingement of the mist upon an inner face of the mouth of the foaming nozzle. The mixture may be injected at a wide angle. The foaming nozzle can be composed of first and second nozzles wherein the second foaming nozzle is of a circular cylinder and hingedly mounted to the first foaming cylinder. The user can selectively inject either a mist-foam mixed cluster having the band section or a foam cluster having a circular section.

14 Claims, 19 Drawing Sheets

FOAMING NOZZLE FOR SPRAYER

BACKGROUND OF THE INVENTION

1. Field of the Invention

The present invention relates to a foaming nozzle to be mounted in a sprayer such as a trigger sprayer. This sprayer is known as a spin sprayer having a spray nozzle for swirling a liquid at a high speed to inject a mist for fungusproofing a joint between tiles laid in a bath room or cleaning a window glass. A foaming nozzle is mounted in the spray nozzle of the spin sprayer so that a fungusproofing detergent may be injected in a foamed state by squeezing the sprayer.

2. Description of the Prior Art

In Japanese Utility Model Laid-open No. 69579/1988, for example, there is disclosed a trigger sprayer. If a foaming nozzle is mounted in the spin spray nozzle of the trigger sprayer and the trigger of the sprayer is squeezed, the mist cluster spin-injected from the spray nozzle impinges upon the inner wall face of the mouth of the foaming nozzle and is mixed with the ambient air and foamed so that a foam cluster is injected from the foaming nozzle mouth.

The foaming nozzle of the prior art is formed into the shape of a true circle cylinder so that the mist cluster injected through the spin passage of the trigger sprayer by squeezing the sprayer has its outer circumferential portion impinging upon the inner face of the foaming nozzle and is foamed until it is injected in the shape of a circular foam cluster. In the trigger sprayer, moreover, the amount of mist to be injected by the single triggering action is substantially fixed so that the foam cluster is injected in a crowd.

The foam cluster usually raises no trouble even if its shape is circular. In case, however, the fungusproofing detergent is to be sprayed along the initially white joints of tiles laid in a bath room, the range of the joints to be covered with the foam can be made wider if the foam is elongated along a joint than if the same is circular. In case, on the other hand, the detergent is to be sprayed on a window glass, the circular foam cluster would overflow and ooze the surrounding, if it is sprayed directly to the corners of the window glass. Thus, the foam cluster is desired to have angular portions. On the other hand, the foam cluster of the prior art is defective in that it will crowd to have a relatively small coverage.

The present invention contemplates to eliminate such defects and enables the foam cluster to be highly diverged by considering the positional relation between the spray nozzle and the foaming nozzle, to be formed into the shape of a transversely elongated band or an ellipse by forming the foaming nozzle into the shape of an elliptical cylinder, and to be injected in a rectangular or triangular shape by forming the foaming nozzle into the shape of a rectangular or triangular cylinder, so that the band-, rectangle- and triangle-shaped foams can be freely selectively injected together with the round foam of the prior art.

SUMMARY OF THE INVENTION

According to the present invention, a foaming nozzle having the shape of an elliptical cylinder is so fitted in the front of a spray nozzle for spin injection that a portion of the mist passing through said foaming nozzle may entrain and diffuse the foam, which is caused in the foaming nozzle, and may be injected in a mist-foam mixed cluster having a cross-section of a transversely elongated band shape. With this structure, it is possible to widen the spray range when a fungusproofing detergent is to be sprayed to the joints between tiles.

According to the present invention, moreover, baffle plates are protruded in the directions to oppose each other from the middle portions of the shorter-diameter peripheral wall portions of the foaming nozzle having the shape of the elliptical cylinder so that the mist-foam mixed cluster injected from the foaming nozzle may be formed into the shape of the transversely elongated band to have higher densities at the two end portions of the band-shaped portion and lower density at the middle portion. This shaping makes it convenient to spray the detergent or the like to the two parallel joints between the tiles and to the intervening tiles, for example.

According to the present invention, moreover, a partition plate for halving a nozzle port is extended between the middle portions of the shorter-diameter peripheral wall portions of the foaming nozzle having the shape of the elliptical cylinder so that the mist-foam mixed cluster injected from the foaming nozzle may be sprayed in two separated smaller circular clusters to the target face. This shaping makes it convenient to spray the aforementioned two parallel joints or the like.

According to the present invention, moreover, arcuate recesses for moving the mist-impinging portion to the front end of the foaming nozzle are formed in the front end face of the shorter-diameter peripheral wall portions of the elliptical cylinder. This shaping makes it possible to spray the aforementioned mist-foam mixed cluster with the elliptical sectional shape effectively to not only the aforementioned joints but also the corners of the window glass.

According to the present invention, moreover, a plurality of grooves for uniformly scattering the mist and foam in the nozzle are formed in the inner face of the shorter-diameter peripheral wall portions of the elliptical cylinder. This shaping makes it possible to scatter the mist and foam all over without being locally deviated.

According to the present invention, the foaming nozzle having the shape of a square cylinder is so fitted in the front of the aforementioned spray nozzle that a part of the mist passing through the foaming nozzle may entrain and diffuse the foam caused in said nozzle until it is injected in a mist-foam mixed cluster having a square section. This shaping makes it possible to spray the detergent to apply the angular portions of the mist-foam mixed cluster to the corners of the window glass, for example, thereby to avoid the wetting of the window frame with the mist-foam mixed cluster.

According to the present invention, moreover, arcuate recesses for moving the mist-impinged portion to the front end of the foaming nozzle having the aforementioned shape of the square cylinder are formed in the front end face of the foaming nozzle. This shaping makes it possible to enlarge the divergence of the mist-foam mixed cluster having the square section.

According to the present invention, moreover, the aforementioned foaming nozzle is formed to have the shape of a rectangular cylinder, and arcuate recesses are formed in the shorter-diameter side wall portions. This shaping makes it possible to form a mist-foam mixed cluster having the rectangular section thereby to convert the aforementioned spray of the joints conveniently into the spray of the window glass corners by making use of the angular portions.

According to the present invention, arcuate recesses are formed in the individual sides at the front end of a triangular cylinder in the front of the aforementioned spray nozzle. This shaping makes it possible to form a mist-foam mixed cluster having a triangular section and makes it convenient to spray the window glass corners or the like by making use of the angular portions.

According to the present invention, moreover, the aforementioned triangular cylinder is a regular triangular cylinder, and the arcuate recesses are formed in the individual sides of the front end of the triangular cylinder. This shaping makes it possible to form a mist-foam mixed cluster having the section of a regular triangle and makes it convenient to spray the window glass corners by making use of the angular portions.

According to the present invention, moreover, the foaming nozzle to be mounted in the front of the aforementioned spray nozzle is composed of a first foaming nozzle and a second foaming nozzle hinged to rise or fall to the front portion of said first foaming nozzle. Moreover, the first foaming nozzle is formed into the shape of an elliptical, rectangular or triangular cylinder, and the second foaming nozzle is formed into the shape of a true circular cylinder. The sectional shape of the mist-foam mixed cluster to be injected by the action of the sprayer with the aforementioned foaming nozzle is formed either into an ellipse other than the true circle by injecting it directly from the first foaming nozzle or into a foam cluster having the section of a true circle by attaching the second foaming nozzle so that the sectional shape of the mist-foam mixed cluster can be freely changed. Specifically, the injection liquid can be changed, in dependence upon the shape or the like of an object, into a mist-foam mixed group or a foam cluster. Moreover, the sectional shape of the mist-foam mixed cluster, i.e., the spray shape of the mist-foam mixed cluster on the sprayed surface can be changed.

BRIEF DESCRIPTION OF THE DRAWINGS

In FIG. 29 showing the relations between the mist clusters spin-injected from the injection nozzle port and the foaming nozzle:

DESCRIPTION OF THE PREFERRED EMBODIMENTS

Figure 1:
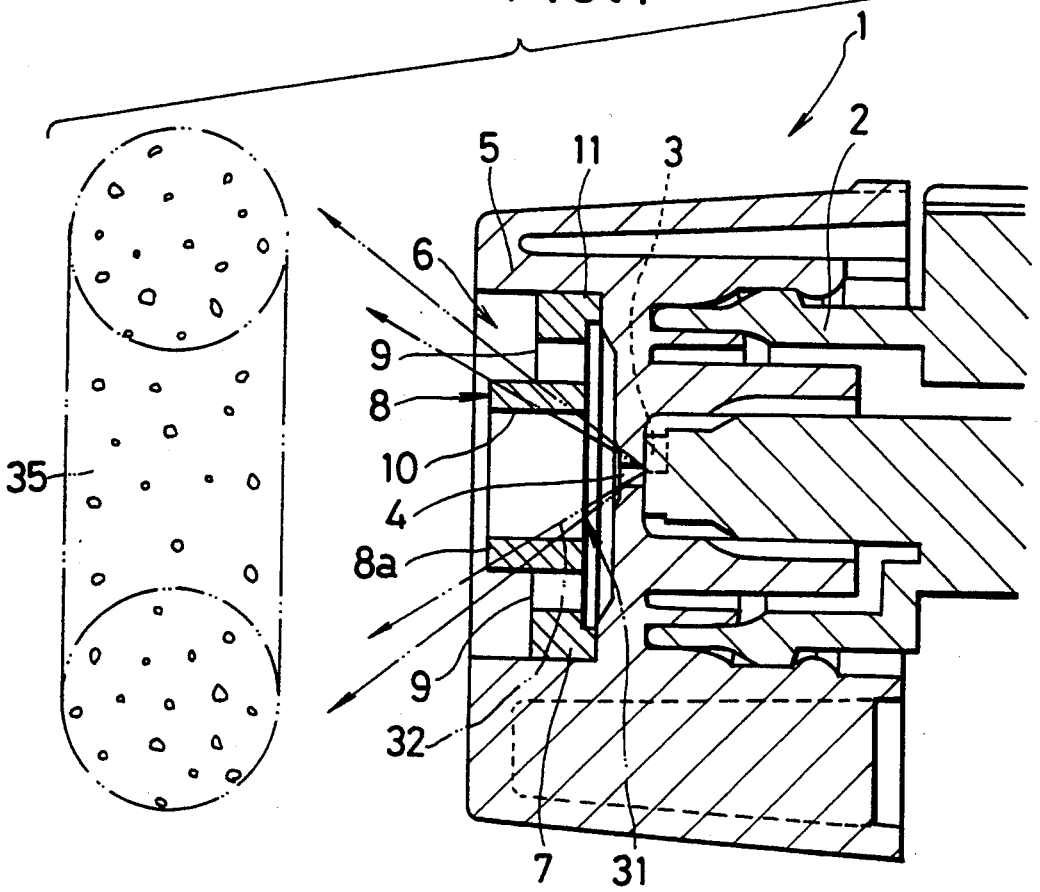
FIG. 1 is a section showing a trigger type sprayer nozzle portion, in which a foaming nozzle having the shape of an elliptical cylinder of the present invention is mounted.

The present invention will be described in more detail with reference to the accompanying drawings.

First of all, a first embodiment of the present invention will be described with reference to FIGS. 1 and 2. Reference numeral 1 designates a spray nozzle for a trigger type sprayer. This spray nozzle 1 is fitted in the front portion of a liquid injection tube 2 of the trigger type sprayer, for example. The injection tube 2 has its front end formed with a well-known spin passage 3, and a spray port 4 is so bored in the center of the front end face of the spray nozzle 1 as to communicate with the passage 3. From the outer circumference of the front end face of the spray nozzle 1, there is protruded forward a cylinder 5 for fitting a foaming nozzle member 6 therein.

This foaming nozzle member 6 has a rectangular base 7 to be fitted in the cylinder 5. The rectangular base 7 is formed in its central portion with an elliptical hole elongated to the right and left, from the peripheral edge of which is protruded forward a foaming nozzle 8 having the shape of an elliptical cylinder. The base 7 is further formed with air vent holes 9 and 9 above and below the nozzle 8. From the outer periphery of the base 7, on the other hand, there is protruded backward a clearance forming cylinder 11 for giving the air vent holes 9 and 9 and a foaming nozzle port 10 the communication with the spray port 4 at the back of the foaming nozzle member 6. The foaming nozzle and the spray nozzle 1 are disposed on a common axis. On the other hand, a denser ring-shaped mist portion 32 surrounding a mist cluster, which is spin-injected in the shape of a hollow cone from the spray port 4 by the squeezing action of the sprayer, is caused to wholly impinge upon the inner faces of shorter-diameter peripheral wall portions 8*a* and 8*a* positioned at the two shorter-diameter sides of the foaming nozzle 8, as shown in FIG. 29C. The denser ring-shaped mist portion 32 is also caused to pass substantially in its entirety over longer diameter peripheral wall portions 8*b* and 8*b* positioned at the two longer-diameter sides, as shown in FIG. 29A, without any impingement.

in the shown embodiment, the foaming nozzle port 10 has the longer diameter of 9 mm, the shorter diameter of 3.5 mm and a length of 4 mm.

With the structure thus made, the liquid is caused to pass through the well-known spin passage 3 formed inside of the spray port 4 so that it is injected forward while swirling at a high speed, if the spray nozzle 1 is directed forward and squeezed. Most of the mist droplets atomized by the high-speed swirls draw a helical locus while having their diameters enlarged the more by the centrifugal force resulting from the swirls as they leave the spray port the more. As a result, the mist cluster 31 formed of all the mist droplets is injected generally in the shape of a hollow cone at a constant injection angle. In other words, the mist cluster 31 is injected in the sectional shape of such a circle by the action of the aforementioned centrifugal force that the outer circumference is the denser ring-shaped mist portion 32 whereas the inside surrounded by the outer circumference is a thinner mist portion.

Figure 29A:
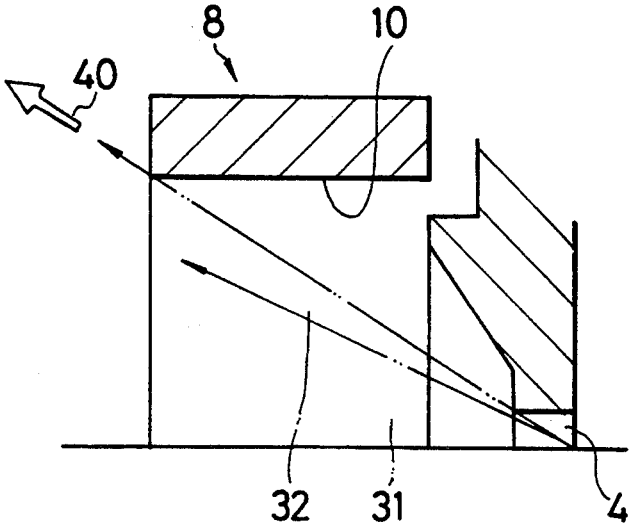
FIG. 29A is a diagram for explaining the portion in which a denser ring-shaped mist portion does not impinge upon the inner face of the foaming nozzle.
Figure 29B:
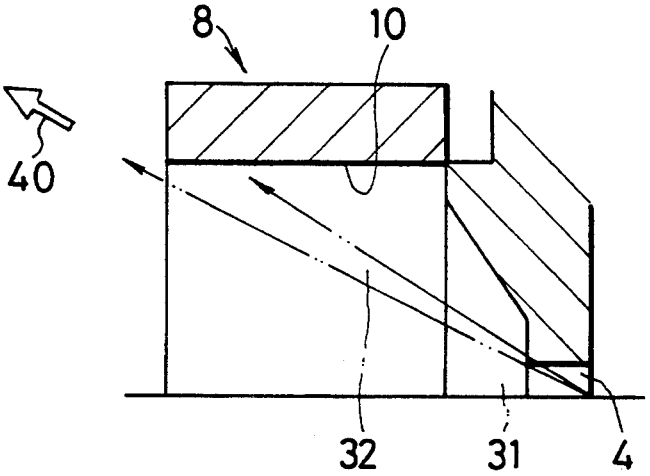
FIG. 29B is a diagram for explaining the portion in which only the outer peripheral portion of the same ring-shaped mist portion impinges.
Figure 29C:
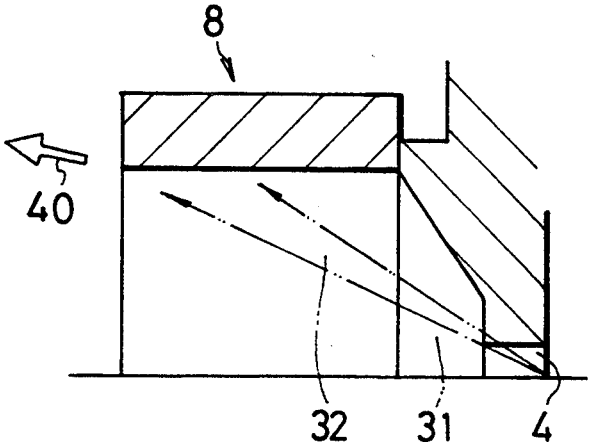
FIG. 29C is a diagram for explaining the portion in which the same ring-shaped mist portion impinges in its entirety.

As described above, the denser ring-shaped mist portion 32 impinges in its entirety on the inner faces of the shorter-diameter peripheral wall portions 8*a* and 8*a*, as shown in FIG. 29C, but not at the longer-diameter peripheral wall portions 8*b* and 8*b*, as shown in FIG. 29A. As a result, the mist portion 32 has its outer peripheral portion impinging but its inner peripheral portion not, as shown in FIG. 29B, between the two end portions of the shorter-diameter peripheral wall portions and the longer-diameter peripheral wall portions 8*b* and 8*b*. At the time of the injection, the foam caused as the result of impingement is mixed with the mist, which is to pass as it is, into a mist-foam mixed cluster 35. The mixed cluster is injected in the sectional shape of a band, as shown in FIG. 1, since it takes the widest injection angle in the case of FIG. 29A, as indicated by blanked arrows 40, and the narrowest injection angle in the case of FIG. 29C. In this case, moreover, the band-shaped sectional portion may have more foam at its two end portions but less foam at the middle. The reason for this phenomenon could be explained in the following manner although not clearly. The injection velocity is decelerated by the foaming, which is caused by the impingement of the denser ring-shaped mist portion 32 at a more backward inner faces of the peripheral wall portions than the case of FIG. 29C, so that the mist will be entrained by the mist portion which is scattered at a high speed over the longer-diameter peripheral wall portions.

Figure 2A:
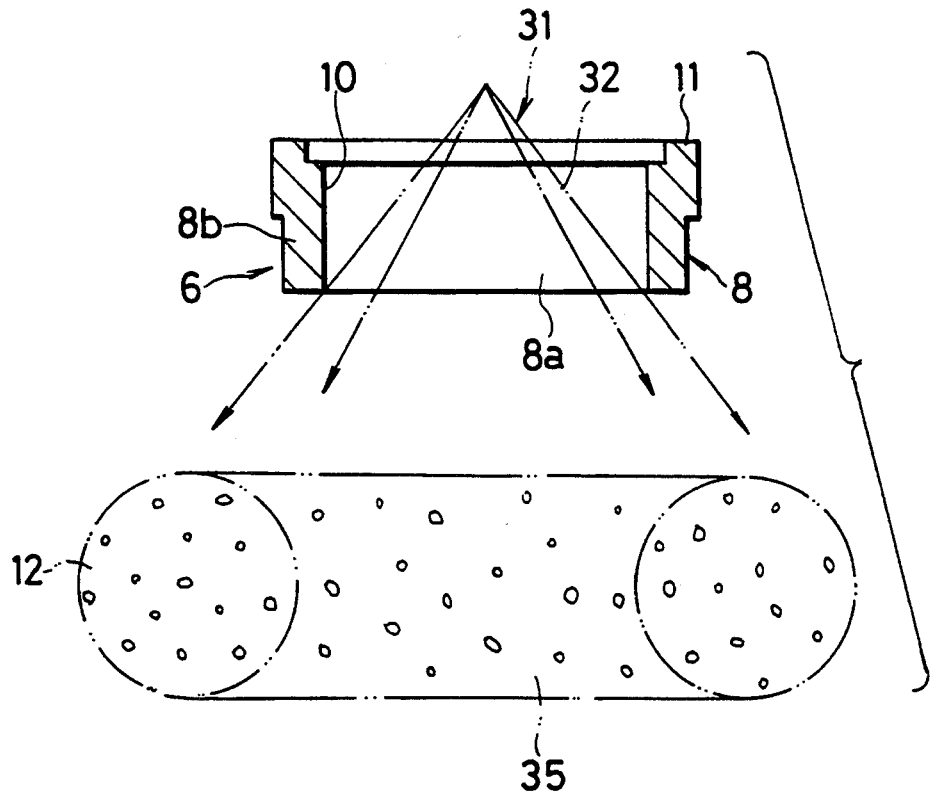
FIG. 2A is a section showing the foaming nozzle shown in FIG. 1.
Figure 3A:
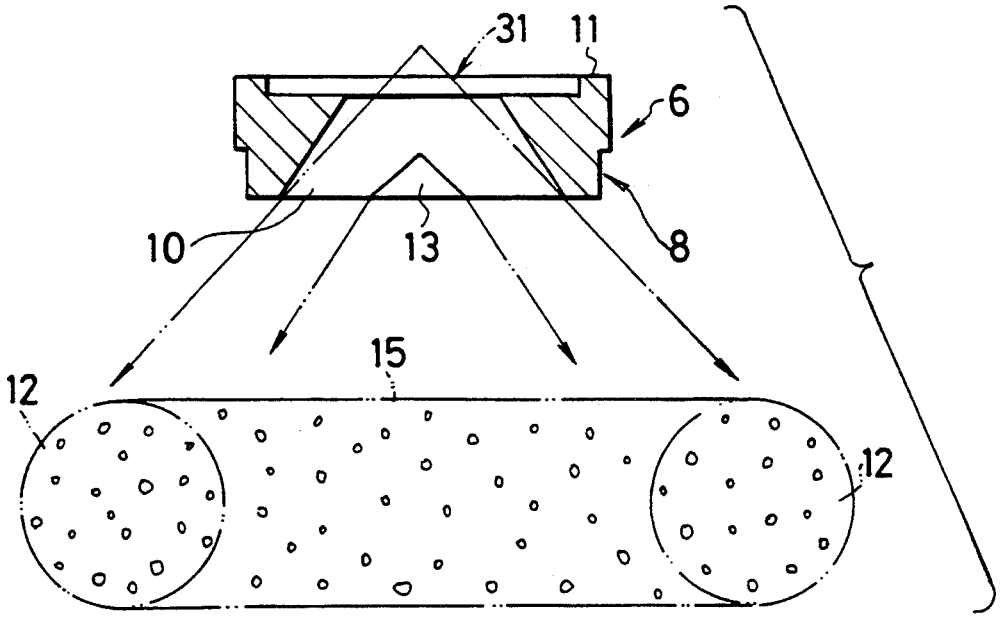
FIG. 3A is a section showing a foaming nozzle having the shape of an elliptical cylinder according to another embodiment and taken in the direction of the longer diameter.
Figure 3B:
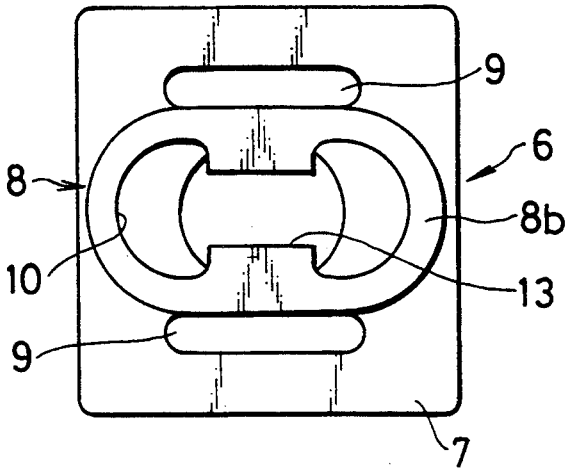
FIG. 3B is a front elevation of the same.
Figure 3C:
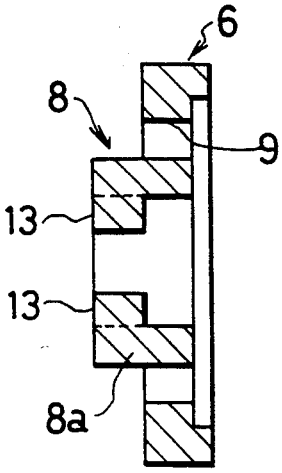
FIG. 3C is a section taken in the direction of the shorter diameter.

In a second embodiment, as shown in FIG. 3, a pair of baffle plates 13 are formed to protrude short in directions to oppose each other from the upper and lower middle portions of the shorter-diameter peripheral wall portions at the front end face of the foaming nozzle having the shape of an elliptical cylinder. If this foaming nozzle is mounted like the first embodiment and is subjected to the injection, the middle portion becomes further thinner with the two end portions being denser than the case of FIG. 2A.

Figure 4A:
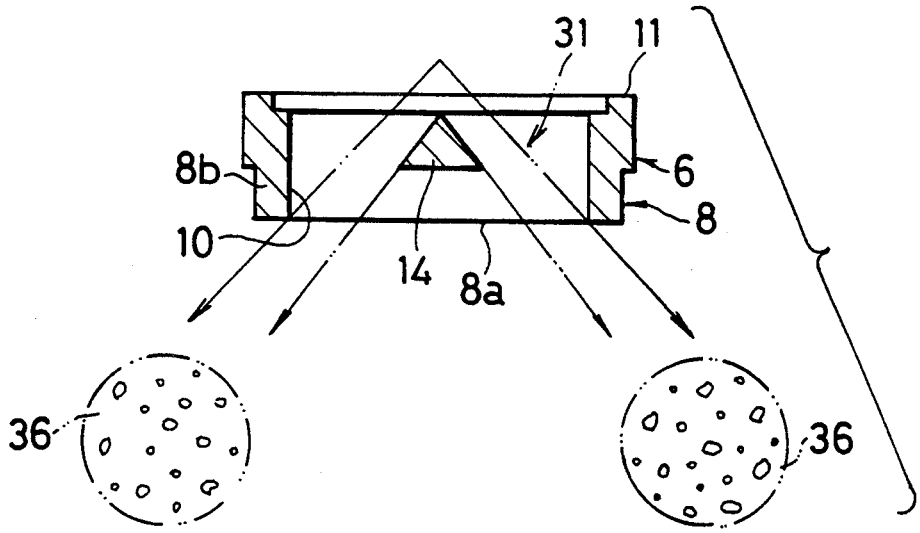
FIG. 4A is a section showing a foaming nozzle having the shape of an elliptical cylinder according to another embodiment and taken in the direction of the longer diameter.
Figure 4B:
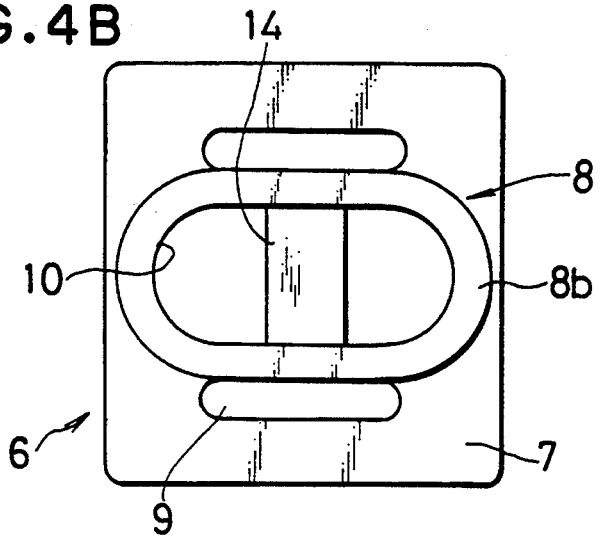
FIG. 4B is a front elevation of the same.
Figure 4C:
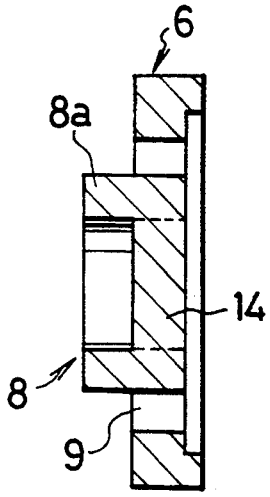
FIG. 4C is a section taken in the direction of the shorter diameter.

In a third embodiment shown in FIG. 4, a partition plate 14 is extended at a middle between the shorter-diameter peripheral wall portions of the foaming nozzle having the shape of an elliptical cylinder so as to halve the nozzle port 10. With this structure, the mist-foam mixed cluster injected from the nozzle port 10 can be injected in two circular clusters 36 and 36 spaced at the righthand and lefthand sides, as shown in FIG. 4A.

Figure 5A:
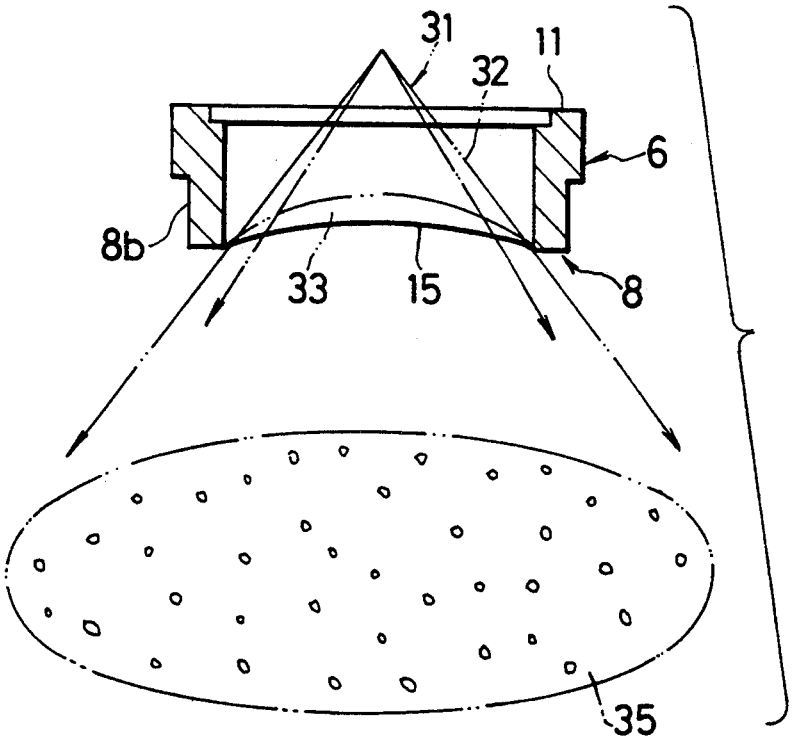
FIG. 5A is a section showing a foaming nozzle having the shape of an elliptical cylinder according to another embodiment and taken in the direction of the longer diameter.
Figure 5B:
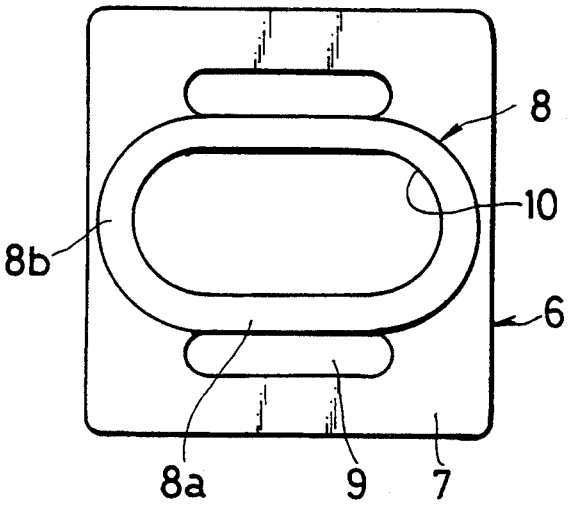
FIG. 5B is a front elevation of the same.
Figure 5C:
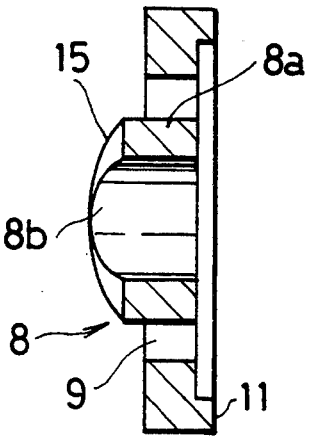
FIG. 5C is a section taken in the direction of the shorter diameter.

In a fourth embodiment shown in FIG. 5, arcuate recesses 15 are formed in the front faces of the shorter-diameter peripheral wall portions at the front end of the foaming nozzle 8 having the shape of an elliptical cylinder so as to cause the denser ring-shaped mist portion 32 to impinge substantially in its entirety upon the front portion of the nozzle port at the longitudinal middle portions of the shorter-diameter peripheral wall portions 8*a* and 8*a* and to have a less impinging range 33 as the ends of these shorter-diameter peripheral wall portions are approached. At the same time, the ring-shaped mist portion 32 is allowed to pass without any impingement over the longer-diameter peripheral wall portions 8*b* and 8*b*. In this case, as shown in FIG. 5A, the mist-foam mixed cluster 35 to be injected has the shape of a transversely elongated generally elliptical shape. Incidentally, in case of the present embodiment, a more ring-shaped mist portion 32 does not impinge directly upon the inner face of the foaming nozzle port 10 so that the mist-foam mixed cluster to be injected from the foaming nozzle port 10 has its injection angle increased and is largely diverged.

Figure 6A:
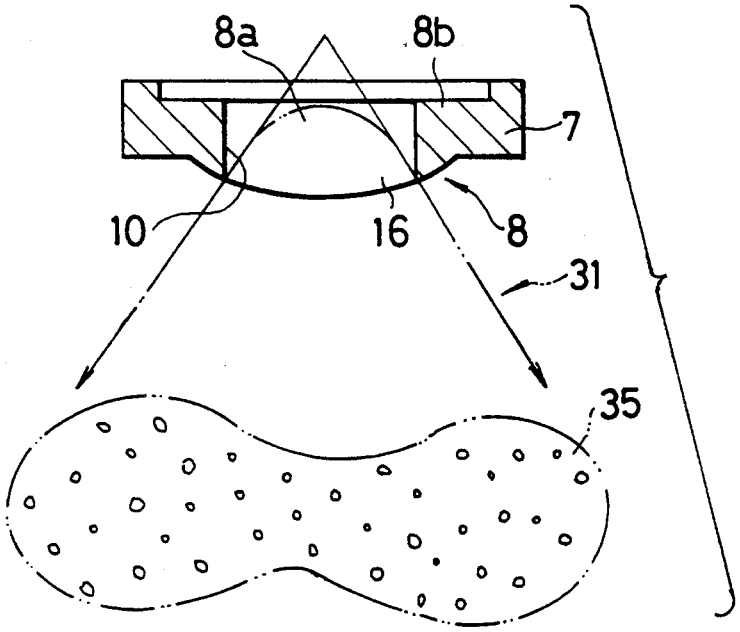
FIG. 6A is a section showing a foaming nozzle having the shape of an elliptical cylinder according to another embodiment and taken in the direction of the longer diameter.
Figure 6B:
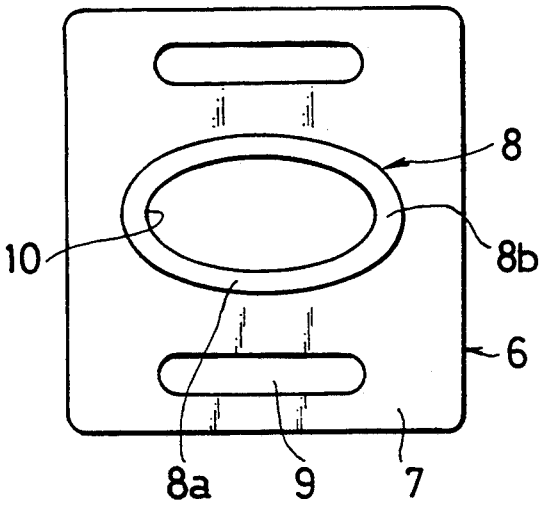
FIG. 6B is a front elevation of the same.
Figure 6C:
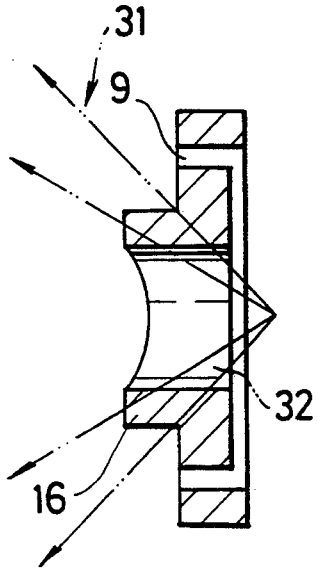
FIG. 6C is a section taken in the direction of the shorter diameter.
Figure 7A:
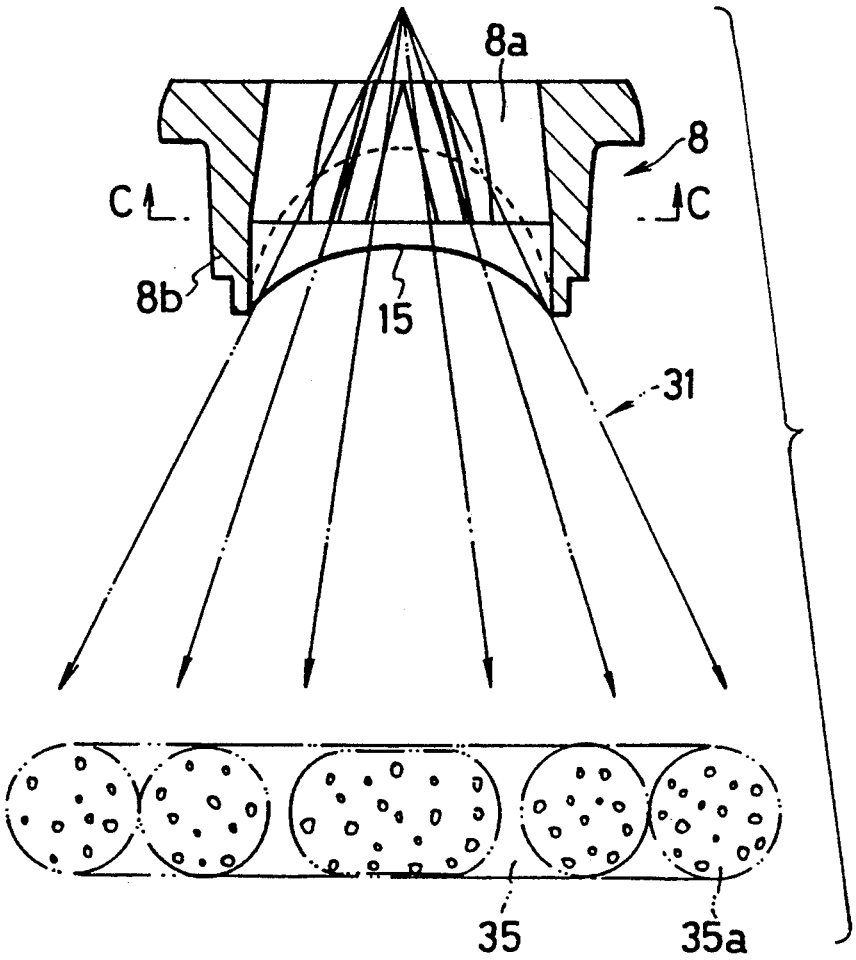
FIG. 7A is a section showing a foaming nozzle having the shape of an elliptical cylinder according to another embodiment and taken in the direction of the longer diameter.
Figure 7B:
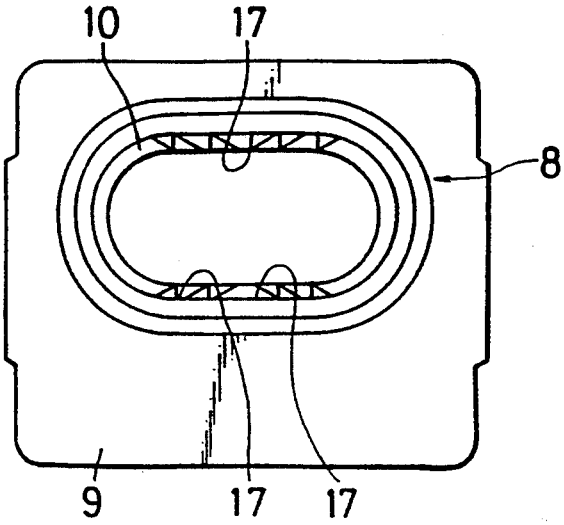
FIG. 7B is a front elevation of the same.
Figure 7C:
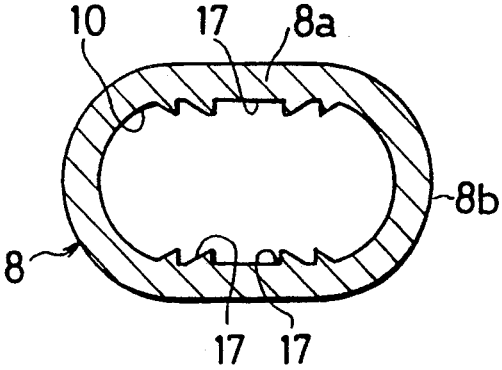
FIG. 7C is a section taken along line C—C of FIG. 7A.

In a fifth embodiment shown in FIG. 6, arcuate protrusions 16 are formed at the front end of the foaming nozzle shorter-diameter peripheral wall portions 8*a* having the shape of an elliptical cylinder so that the ring-shaped mist portion 32 may pass closely over the longer-diameter peripheral wall portions 8*b*. At the inner faces of the shorter-diameter peripheral wall portions 8*a*, therefore, the foam cluster is extruded along the inner faces of the protrusions 16 even after the mist portion 32 has impinged upon the inner faces of the shorter-diameter peripheral wall portions 8*a* and has been foamed. Moreover, the foam cluster is entrained by the ring-shaped mist scattered at a high speed toward the longer-diameter peripheral wall portions, so that the mist-foam mixed cluster 35 is injected in the shape of a cocoon, as shown in FIG. 6A.

in a sixth embodiment shown in FIG. 7, a plurality of grooves 17 are so formed in the inner faces of the foaming nozzle shorter-diameter peripheral wall portions 8*a* having the shape of an elliptical cylinder that they are radially dispersed forward from the back. The mist-foam mixed cluster 35 injected in the shape of a band, as shown in FIG. 7A, are dispersed by those grooves 17 into denser mist-foam mixed clusters 35*a* spaced generally at an equal distance.

Figure 2B:
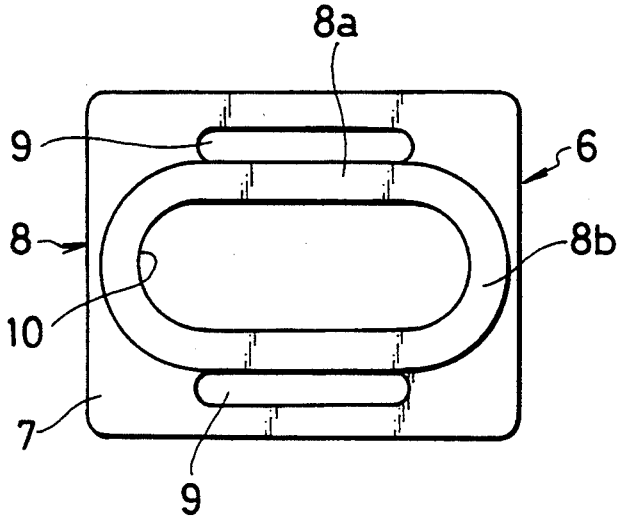
FIG. 2B is a front elevation of the same.
Figure 8:
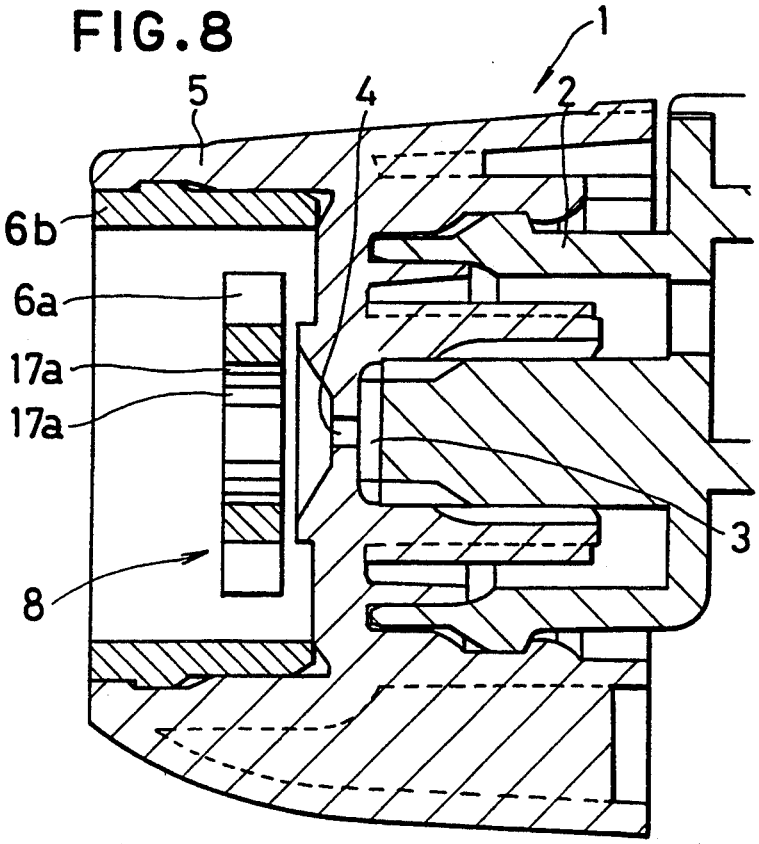
FIG. 8 is a section showing a trigger type sprayer mouth portion, in which a foaming nozzle having the shape of a square cylinder of another embodiment is mounted.
Figure 9:
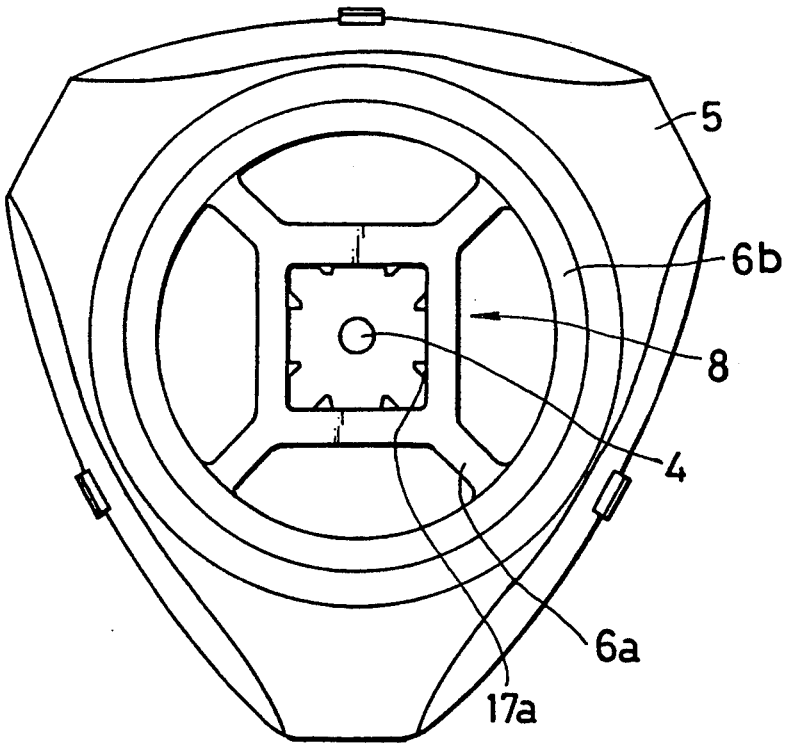
FIG. 9 is a front elevation showing the sprayer mouth portion.
Figure 10:
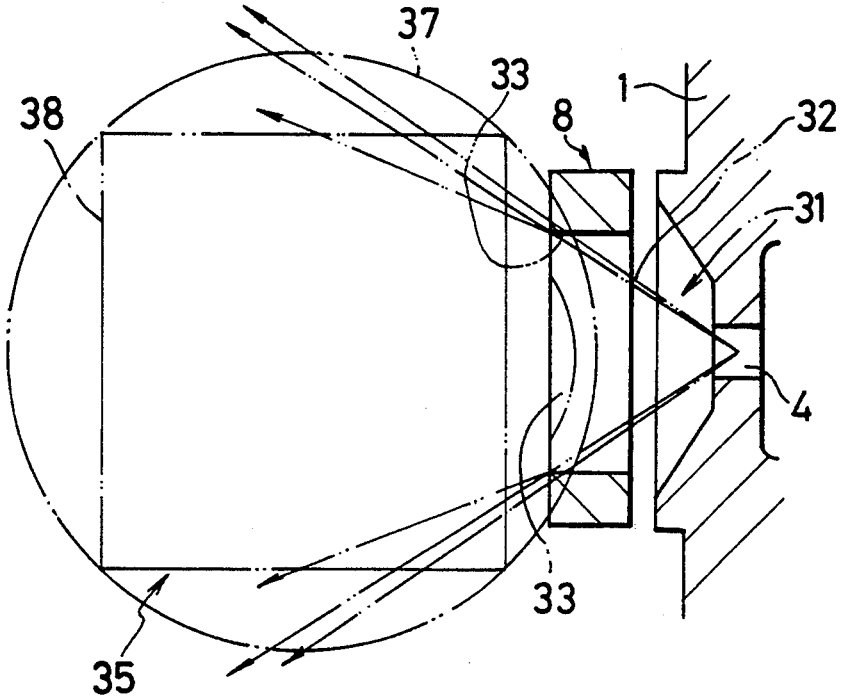
FIG. 10 is a diagram for explaining the operation of the foaming nozzle mounted in the same sprayer.

The front end faces of the shorter-diameter peripheral wall portions 8*a* are formed into the arcuate recesses 15 but may be formed into the shape of a plane normal to the axis, as in the embodiment of FIGS. 1 and 2. In the shown embodiment, the grooves 17 are extended from the rear end of the foaming nozzle to just the front of the middle but not to the front portion. This is to facilitate the extraction and machining of the molding die when the foaming nozzle is integrally molded of a synthetic resin. For this, the inner face portion of the foaming nozzle to be formed with the grooves is tapered to have a reduced diameter rear end.

in a seventh embodiment shown in FIGS. 8 to 10, the foaming nozzle 8 is formed into the shape of a square cylinder. A cylinder 6*b* with the foaming nozzle 8 has its two front and rear end faces opened, and four support members 6*a* are equidistantly protruded from the inner face of the rear portion and connected to the individual corners of the outer face of the foaming nozzle 8. The inner face of the cylindrical wall of the foaming nozzle 8 may be formed with spray guide members 17*a* in place of the aforementioned grooves. The foaming nozzle 8 is so positioned that the denser ring-shaped mist portion 32 may impinge in its entirety upon the middles of the individual sides of the foaming nozzle having the shape of the square cylinder and may be foamed, as shown in FIG. 29C. At the corners of the front end of the foaming nozzle, on the other hand, the mist portion 32 is caused to pass without any impingement, as shown in FIG. 29A. As a result, the mist portion 32 is partially foamed while the remainder is allowed to pass between the middles of the individual sides and the corners of the front end of the foaming nozzles, as shown in FIG. 29B. As has been described, the aforementioned mist and foam are mixed into their mixed cluster 35, which has the shape of a square 38 circumscribed by a true circle 37 having the section of the extension of the outer circumference of the denser ring-shaped mist portion 32.

Figure 11:
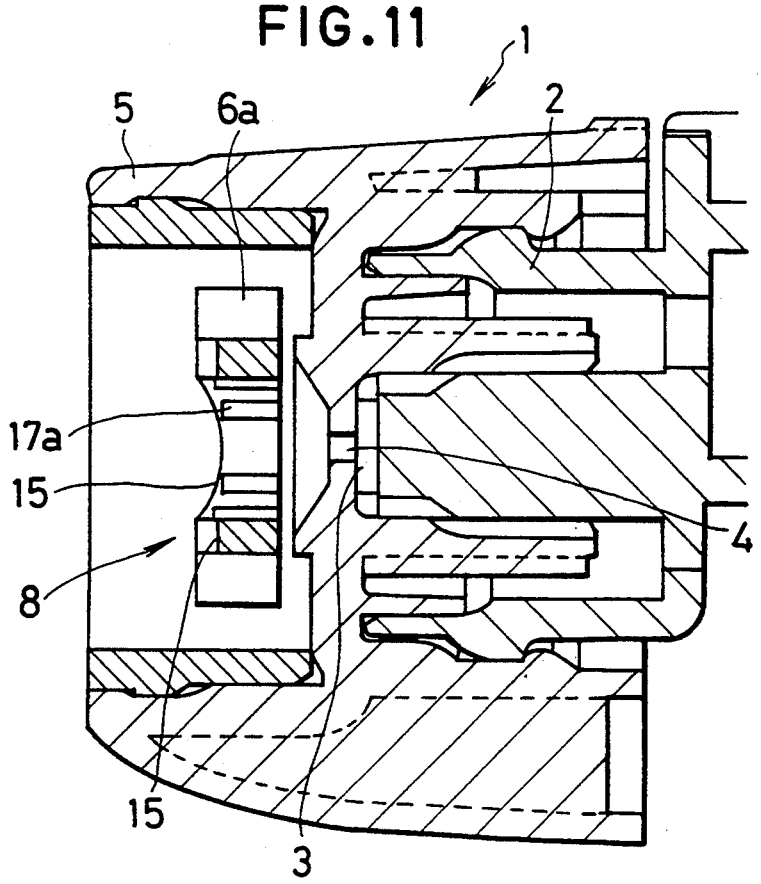
FIG. 11 is a section showing a trigger type sprayer mouth portion, in which a foaming nozzle having the shape of a square cylinder of another embodiment is mounted.
Figure 12:
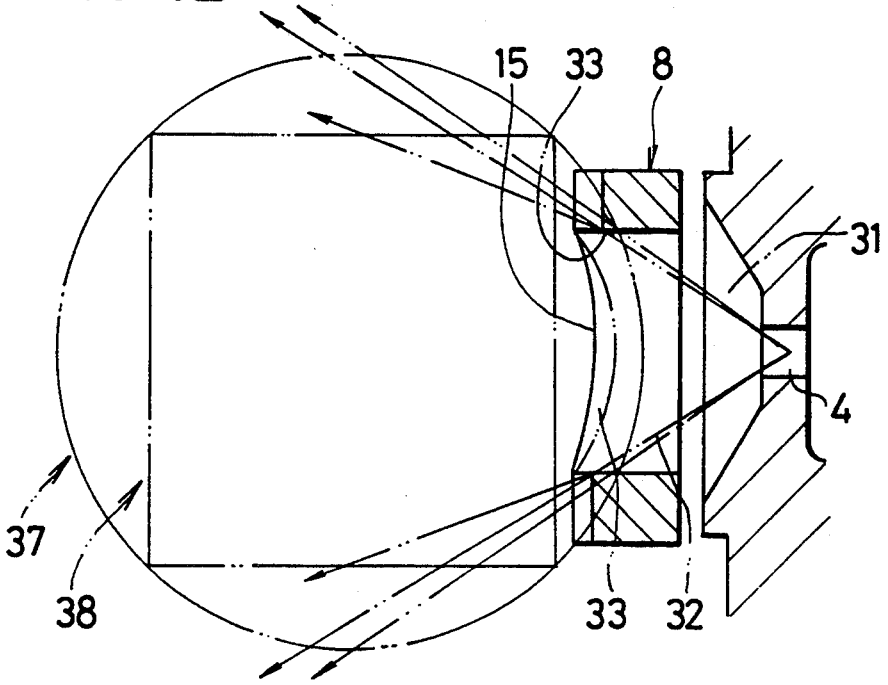
FIG. 12 is a diagram for explaining the operation of the foaming nozzle mounted in the same sprayer mouth portion.
Figure 13:
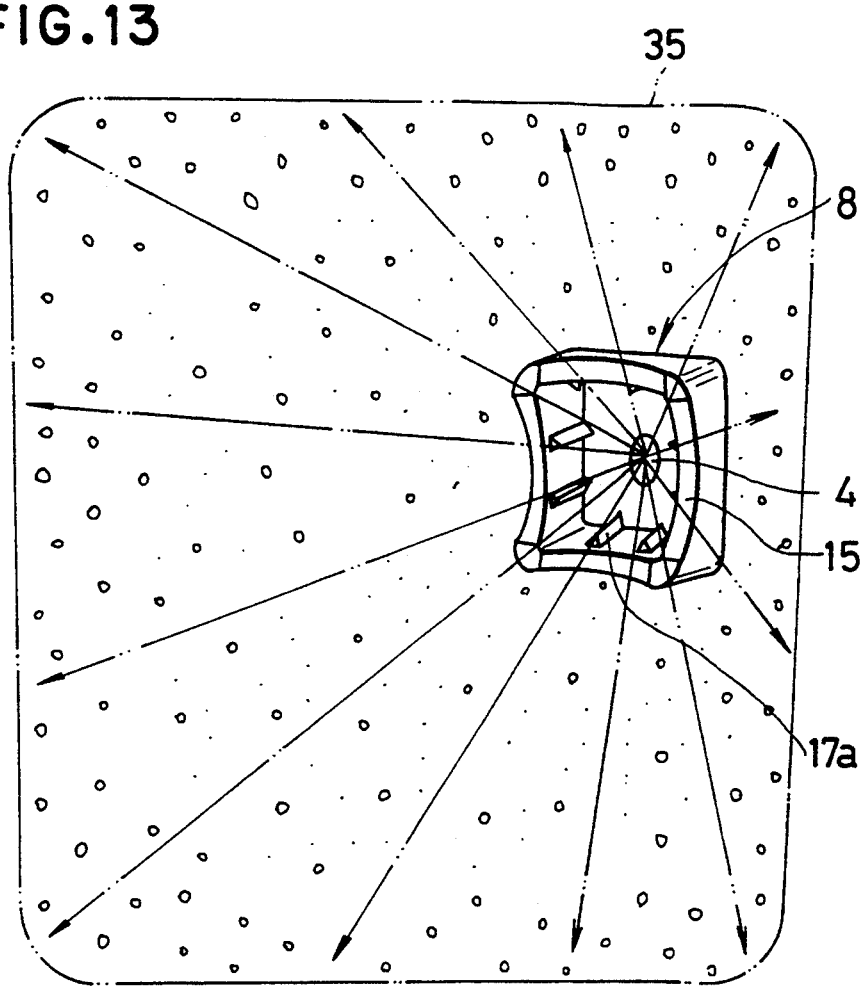
FIG. 13 is a diagram for explaining a foam cluster injected from the foaming nozzle.

In case the foaming nozzle 8 is given the shape of a square cylinder, the arcuate recesses 15 are desirably formed between the two ends of the front faces of the individual sides of the square formed by the front end face of the foaming nozzle, as shown in FIGS. 11 to 13. By forming the impinging range 33 elongated along the arcuate recesses, the foaming can be effected all over the inner face of the mouth without any deviation, so that the mist and foam can be dispersed substantially uniformly, as shown in FIG. 13.

Figure 14:
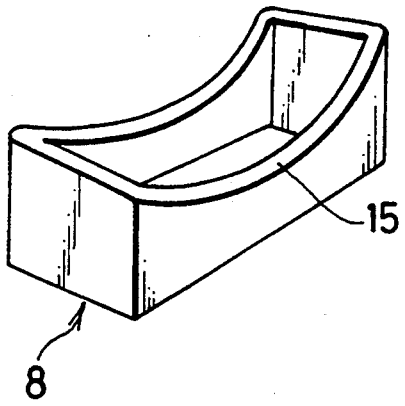
FIG. 14 is a perspective view showing a foaming nozzle having the shape of a rectangular cylinder according to another embodiment.
Figure 15:
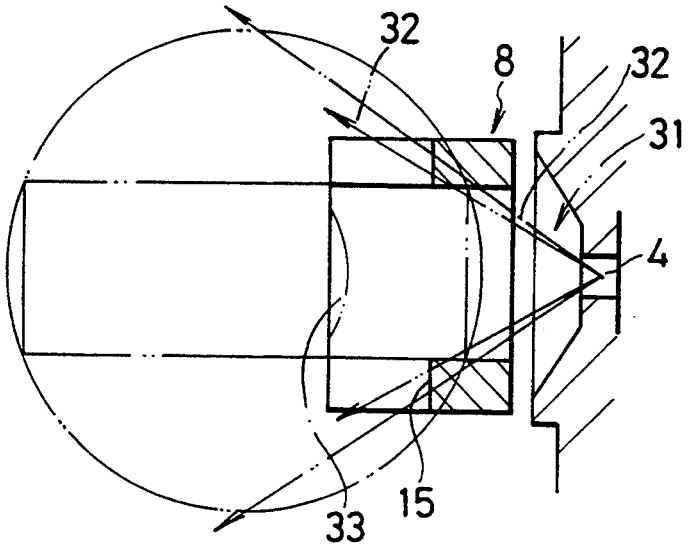
FIG. 15 is a diagram for explaining the operations of the same foaming nozzle.
Figure 16:
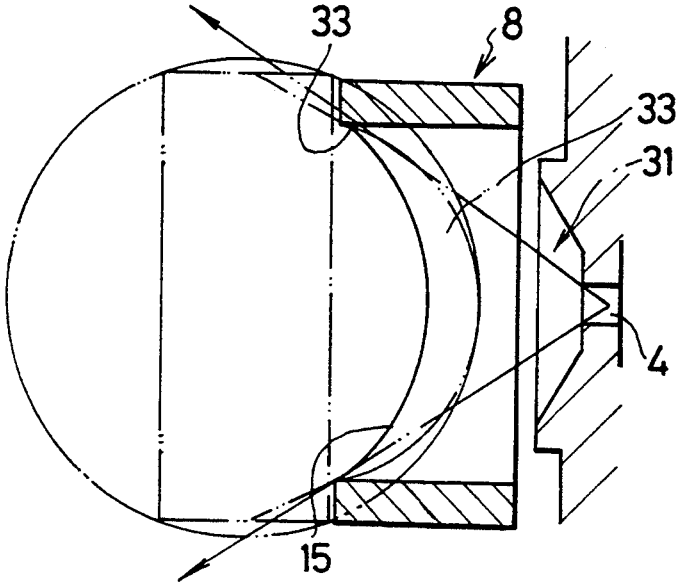
FIG. 16 is a diagram for explaining the operations of the same foaming nozzle.

In an embodiment shown in FIGS. 14 to 16, the foaming nozzle 8 is formed into the shape of a rectangular cylinder. In this case, the arcuate recesses 15 are formed in the front faces of the longer sides of the rectangular cylinder so that the denser ring-shaped portion 32 of the mist cluster 31 injected through the foaming nozzle 8 may impinge more on the inner faces of the arcuate recesses 15 and less on the inner faces of the shorter sides but may pass closely over the front end portions of the four corners. In case of the foaming nozzle having the rectangular cylinder shape, the mist cluster impinging range 33 at the longer side, as shown in FIG. 16, is far longer than that at the shorter side, as shown in FIG. 15. This is because the distance from the spray port 4 is so different that the mist cluster 31 injected in the shape of a hollow cone having a denser ring-shaped mist portion impinges at its outer circumference upon the longer sides in an earlier stage in which the cluster has a small-diameter section, and upon the shorter sides at a later stage in which it has a larger-diameter section.

Figure 17:
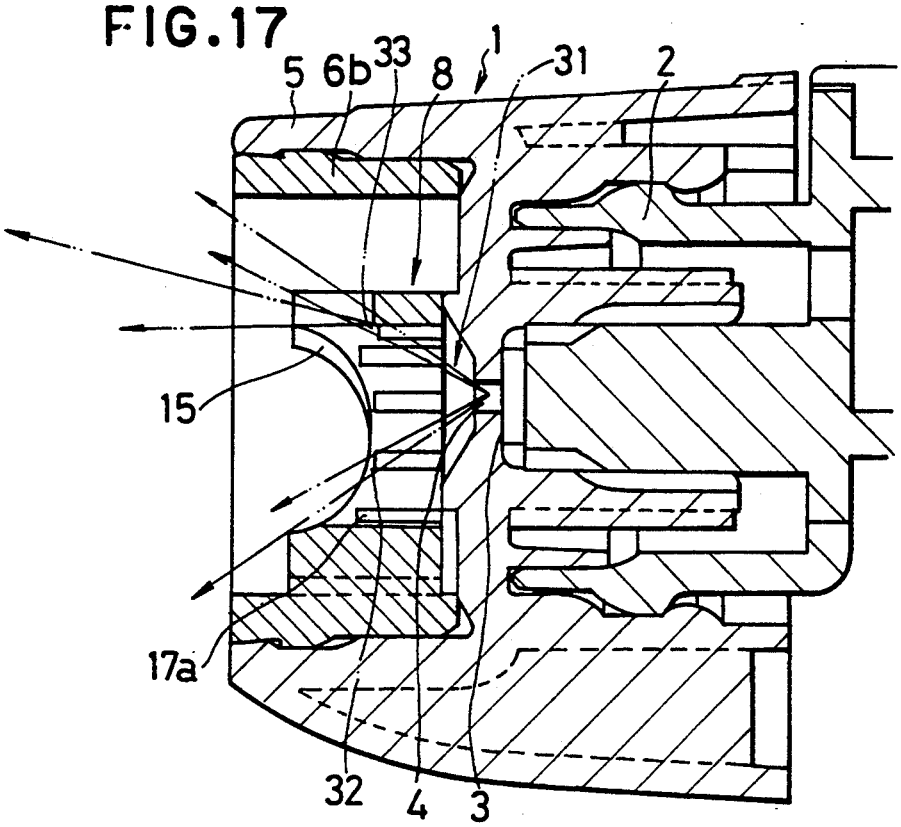
FIG. 17 is a section showing a trigger type sprayer mouth portion, in which a foaming nozzle having the shape of a triangular cylinder of another embodiment is mounted.
Figure 18:
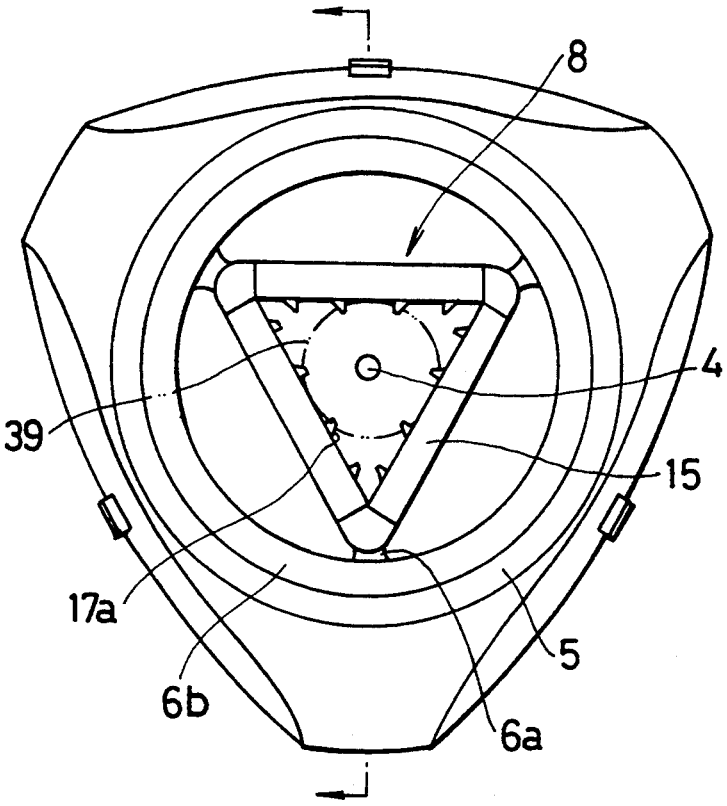
FIG. 18 is a front elevation showing the same sprayer mouth portion.
Figure 19:
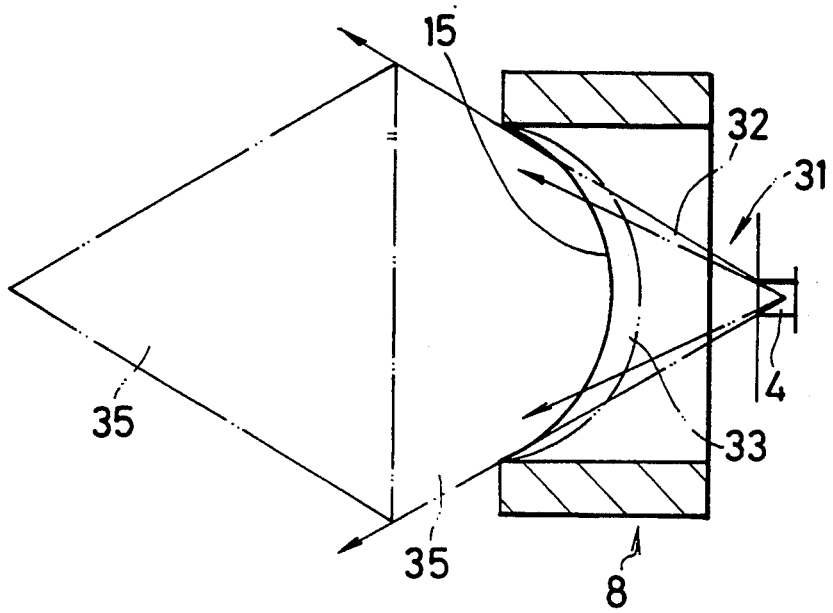
FIG. 19 is a diagram for explaining the operation of the foaming nozzle mounted in the same sprayer.
Figure 20:
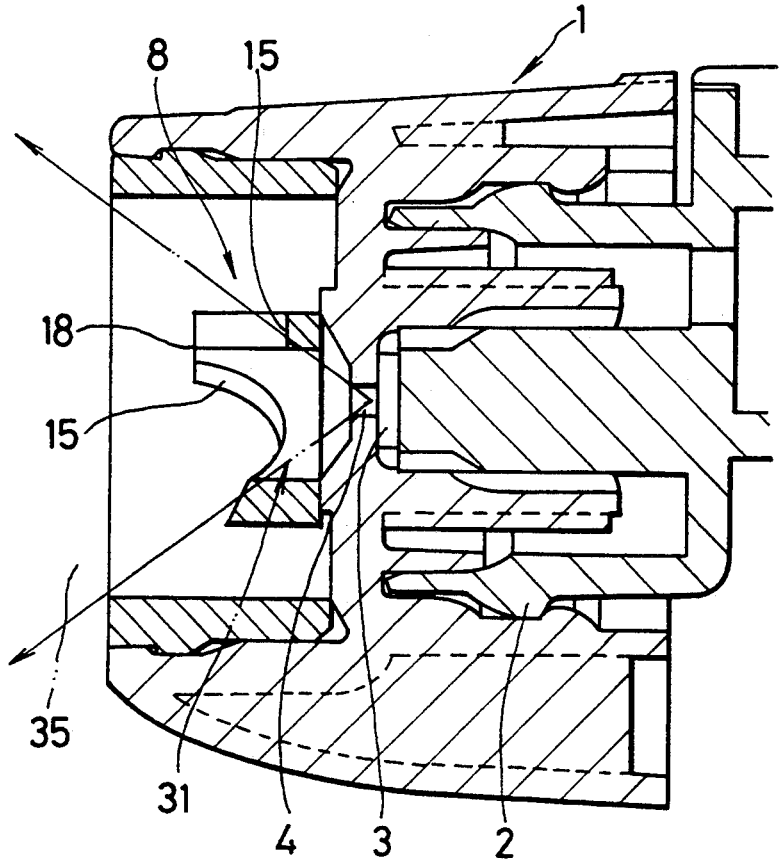
FIG. 20 is a section showing a trigger type sprayer mouth portion, in which a foaming nozzle having the shape of an isosceles triangular cylinder of another embodiment is mounted.
Figure 21:
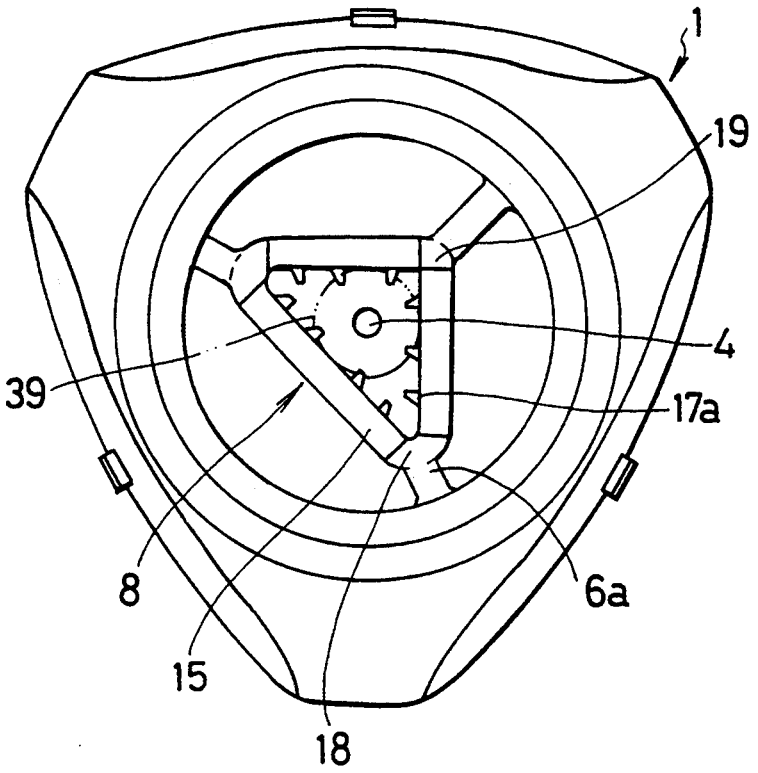
FIG. 21 is a front elevation showing the same sprayer mouth portion.
Figure 22:
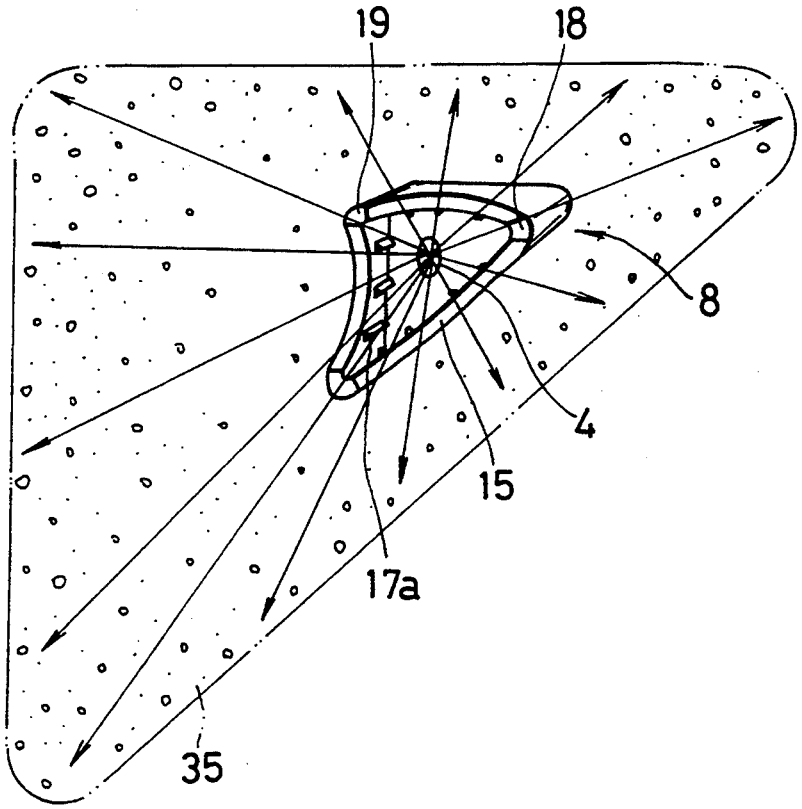
FIG. 22 is a diagram for explaining a mist-foam mixed cluster injected from the same foaming nozzle.

In an embodiment shown in FIGS. 17 to 19, the foaming nozzle 8 is formed into the shape of an equilateral triangle cylinder. In case of this embodiment, too, the cylinder 6*b* with the foaming nozzle 8 is fitted in the cylindrical portion 5 of the spray nozzle 1. The cylinder 6*b* is a cylinder having its front and rear end faces opened, and the foaming nozzle 8 is connected coaxially to the cylinder 6*b* by the three support members 6*a* protruded at an equal spacing from the inner face of the rear portion of the cylinder 6*b*. As shown, the spray guide members 17*a* may be formed on the inner face of the cylindrical wall portion defining the inner face of the foaming nozzle.

In case of the present embodiment having the mouth shaped in the equilateral triangle, as shown in FIG. 19, the arcuate recesses 15 of a common size are formed between the two ends of the individual sides with the most depression at the middle of each side. Most of the denser ring-shaped mist portion 32 impinges upon the middle portions of the individual sides, and its impinging range 33 is reduced the more the two ends of the individual sides are approached, until its outer side closely passes at the two ends of the individual sides, i.e., at the front ends of the corners of the triangular mouth, as shown in FIG. 29A.

In an embodiment shown in FIGS. 20 to 26, the foaming nozzle 8 is formed into the shape of a right angle triangle cylinder. In case of this embodiment, as different from the case of the equilateral triangle cylinder, the distances from the center of the inscribed circle 39 of the right angle triangle to an acute angle portion 18 and to a right angle portion 19 are different, and the distances from that center to the middle of the two sides containing the right angle and to the middle of the remaining side are different. In the structure in which the center of the inscribed circle 39 is positioned on the extension of the center axis of the spray port 4, therefore, the mist cluster 31 injected in the shape of the hollow cone from the spray port 4 has its outer circumference impinging at first upon the portion, in which the inscribed circle and the individual sides contact, and then radially enlarged so that the impinging range 33 is circumferentially extended to reach the front end of the inner face of the right angle portion 19 and further the front end of the inner face of the acute angle portion 18 as the outer circumference is moved forward.

Figure 23:
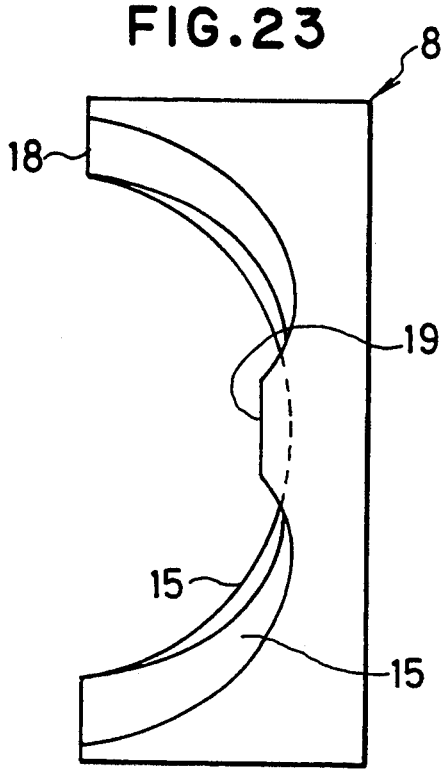
FIG. 23 is a side elevation of the same foaming nozzle.
Figure 24:
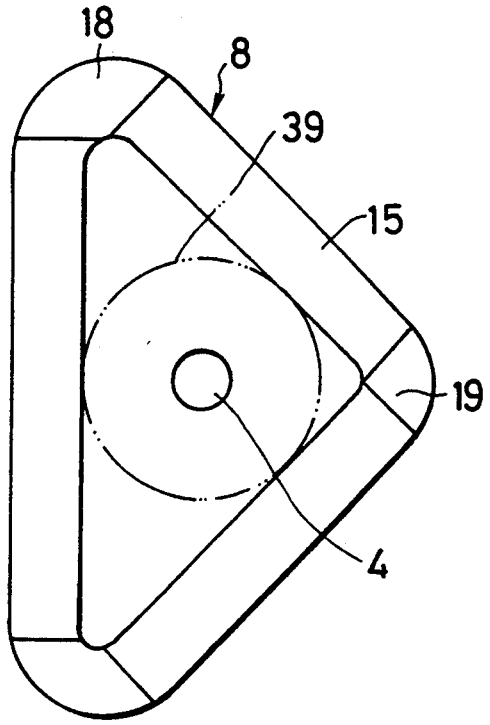
FIG. 24 is a front elevation showing the same foaming nozzle.

Mist-foam mixed cluster 35 is formed by causing the spin-injected mist cluster to impinge upon the inner face of the mouth. In order that the sectional shape of the mist-foam mixed cluster 35 may be formed into the section of a right angle triangle and gradually enlarged, the denser ring-shaped mist portion passing without impingement has to be minimized at the mouth portion which is first hit by the outer circumference of the mist cluster 31, and the denser ring-shaped mist portion passing without impingement has to be maximized at the mouth portion which is hit the latest. Moreover, the outer side of the mixed cluster 35 of the foam or the like caused by the impingement has to be corrected in the scattering direction so that its section may have the shape of the right angle triangle as a whole and that its triangle may be gradually enlarged. For this, as shown in FIG. 23, the right angle portion 19 is made shorter than the acute angle portion 18 to form the arcuate recesses 15 in the front end portions of the individual sides. Incidentally, the acute angle portion 18 is so formed that the denser ring-shaped mist portion of the mist cluster 31 has its outer face come close to but passes angle portion 18 without any impingement.

Figure 25A:
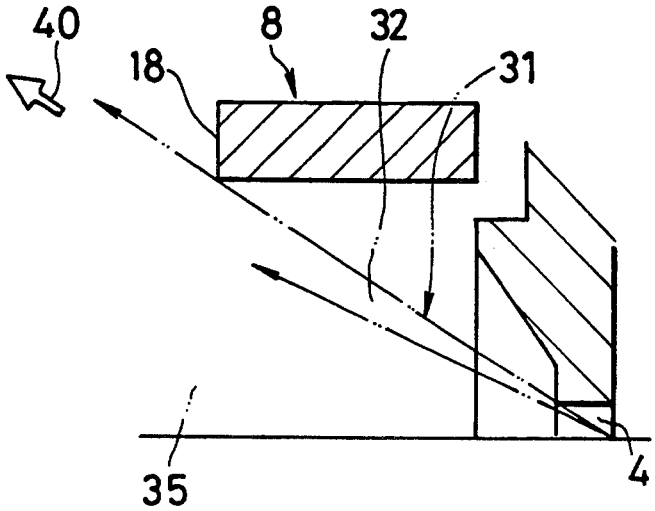
FIGS. 25A, 25B and 25C are diagrams for explaining the impinging ranges of the mist cluster upon the inner faces of the individual portions of the front end of the same foaming nozzle.
Figure 25B:
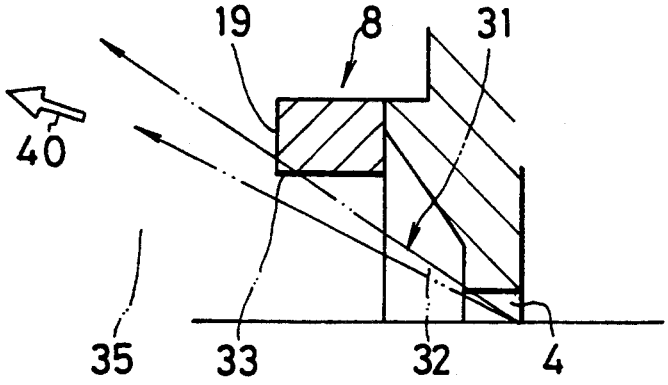
Figure 25C:
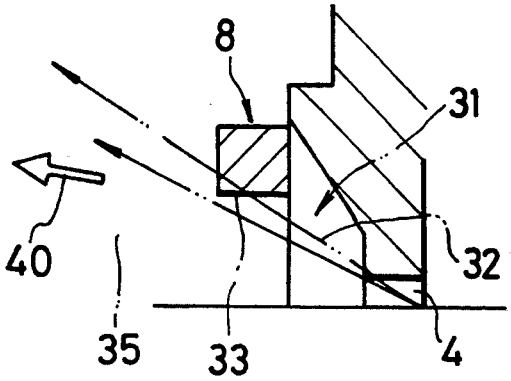
Figure 26A:
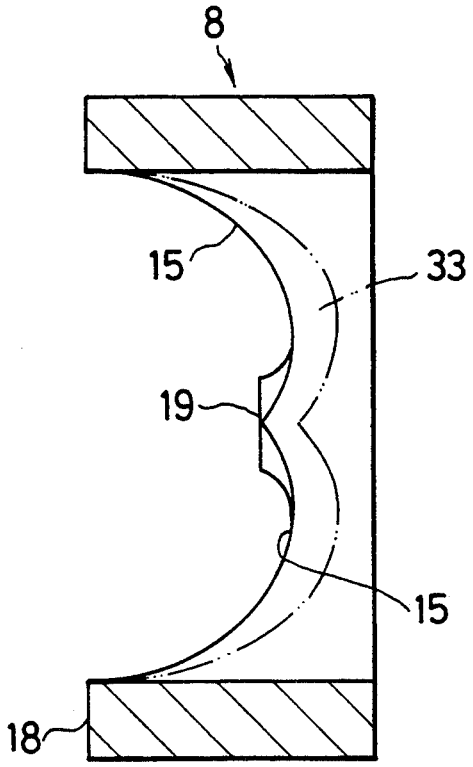
FIGS. 26A and 26B are sections showing the same foaming nozzle.
Figure 26B:
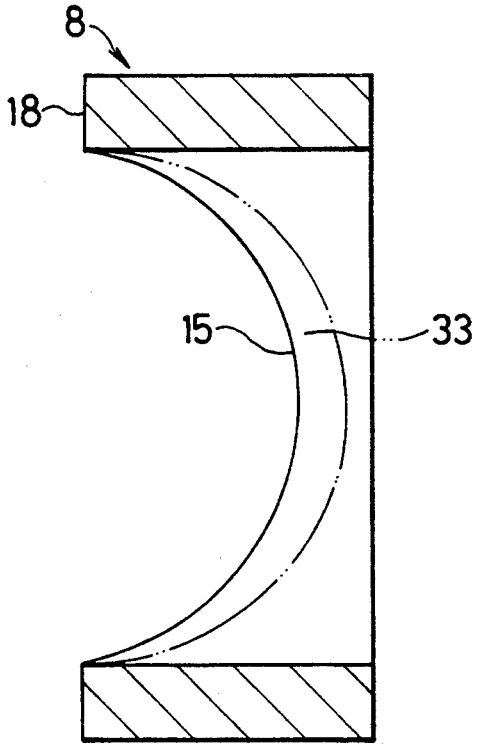

FIG. 25 shows the ratio of the amount of the denser ring-shaped mist portion of the mist cluster that impinged upon the individual portions of the inner face of the mouth of the foaming nozzle 8, and the amount of the same that was scattered without any impingement. FIGS. 25A and 25B show the acute angle portion 18 and the right angle portion 19 of the foaming nozzle, respectively. FIG. 25C shows such a portion of each side, in which the inscribed circle 39 and the inner edge of each side contact, as shown, that the mist cluster impinges on the inner face of the mouth at the earliest stage. The blanked arrows 40 indicate the corrected injection direction of the outer side of the mixed cluster 35 of the foam or the like caused as a result of the impingement. In the case of FIG. 25A, the foam already caused at the portions of FIGS. 25C and 25B are scattered and mixed, as the mist comes closer to the front end of the acute angle portion 18 as the front end of the foaming nozzle 8, so that the denser ring-shaped mist portion has its density reduced and is injected as the mist-foam mixed cluster 35 from the mouth. FIGS. 26A and 26B show the impingement range 33 of the mist cluster on the inner face of the foaming nozzle mouth.

The regular triangle cylinder and the rectangular equilateral triangle cylinder are exemplified as the desired shape of the foaming nozzle of a triangular cylinder but can naturally be exemplified by another triangular cylinder. In this modification, arcuate recesses according to the individual sides of the mouth have to be formed in the front end faces of the side portions in accordance with the case of the rectangular equilateral triangular cylinder.

Since the mist injection angles of the mist clusters of the aforementioned individual embodiments are determined depending upon many conditions including the number of swirls of the spray pressure spin and the length and diameter of the spray port, the sprayer for mounting the foaming nozzle has to be equally sized. For fine adjustment of tills spray angle, moreover, the spray nozzle 1 may desirably be screwed in the injection tube 2, or the foaming nozzle member 6 may desirably be screwed in the spray nozzle 1 so that the spray nozzle 1 may be adjusted with respect to the injection tube or so that the aforementioned member 6 may be adjusted with respect to the spray nozzle.

Figure 27:
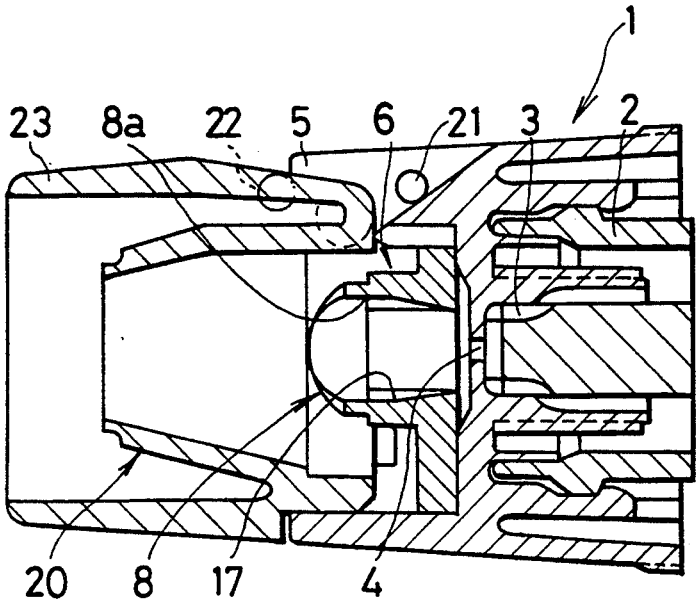
FIG. 27 is a section showing the state, in which a second foaming nozzle is mounted in the mouth portion of the trigger sprayer having the foaming nozzle of the embodiment of FIG. 7 mounted therein.
Figure 28:
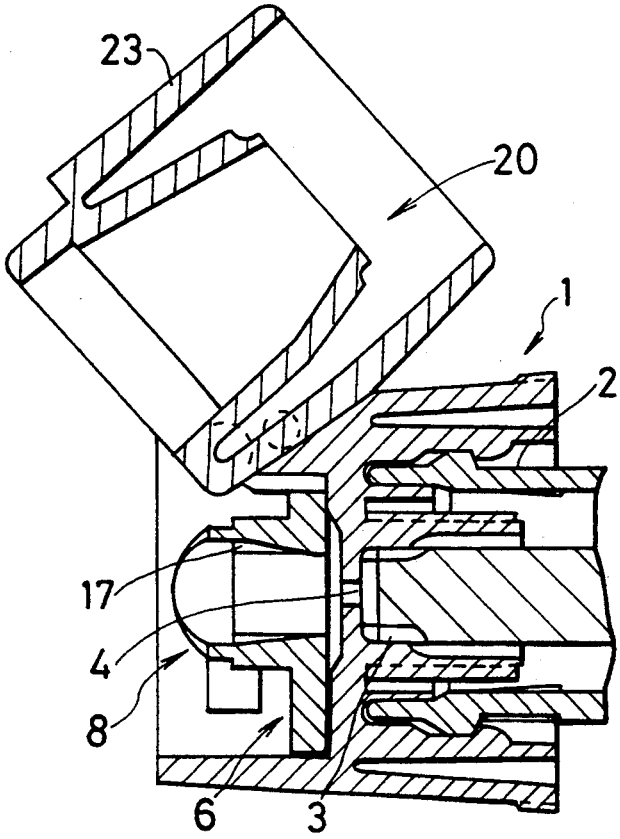
FIG. 28 is a section showing the state, in which the same second foaming nozzle is raised.

In an embodiment shown in FIG. 27, the cylinder 5 having the foaming nozzle member 6 fitted therein has its upper portion notched, and a second foaming nozzle 20 formed with a nozzle hole having the cross-section of a true circle has its rear portion fitted in the front portion of the cylinder 5. The second foaming nozzle 20 has its rear portion which is so hinged to the cylinder 5 in the aforementioned notch portion, that said second foaming nozzle can be freely raised or fallen. In this embodiment, the first foaming nozzle 8 owned by the foaming nozzle member 6 and the second foaming nozzle 20 constitute together a foaming nozzle structure. The first foaming nozzle is formed into the shape having an elliptical cylinder so that the mist-foam mixed cluster 35 having the cross-sectional shape of an ellipse or band injected from the first foaming nozzle can be changed, if necessary, into a foam cluster having the cross-section of a true circle by mounting the aforementioned second foaming nozzle 20. In other words, the injected liquid can be freely changed into a foam cluster of a true circle or into a mist-foam mixed cluster of an ellipse or band by mounting or demounting the second foaming nozzle. The first foaming nozzle 8 of this embodiment is exemplified by the foaming nozzle having its inner face formed with the grooves 17, as shown in FIG. 7, but may be exemplified by the square or triangle foaming nozzles of the remaining embodiments. Incidentally, the cylinder 5 and the second foaming nozzle 20 are formed with retaining holes 21 and projections 22 for retaining the position of the second foaming nozzle when this nozzle is turned and fallen upward. Incidentally, an output cylinder 23 in the shown embodiment, is protruded in the shape of a double cylinder from the back of the second foaming nozzle.

To the front end portion of the spin spray nozzle of a sprayer, according to the present invention, there is so fitted coaxially with the spray nozzle a foaming nozzle having the shape of an elliptical, rectangular or triangular cylinder that the denser ring-shaped mist portion in the outer circumference of the mist cluster spin-injected in the shape of a hollow cone from the spray port 4 is partially refrained from impinging upon the inner face of the foaming nozzle whereas the remaining ring-shaped mist portion impinges upon the inner face of the foaming nozzle and is foamed until the foam and a portion of the mist are mixed and injected. As a result, depending upon the shape of the foaming nozzle, the mist-foam mixed cluster can be injected in the shape of a band, ellipse, rectangle or triangle so that it can be efficiently sprayed on a joint between tiles or a corner of a window glass. As has been described above, moreover, the denser ring-shaped mist portion is partially caused to pass as it is without impinging upon the inner face of the foaming nozzle and is mixed during the passage with the foam caused on the nozzle inner face so that the mist-foam mixed cluster is prepared. As a result, the mixed cluster can have its injection angle enlarged to extend the range of the area to be sprayed. If, moreover, the foaming nozzle is formed of the first foaming nozzle 8 having the shape of a non-circular section and the second foaming nozzle 20 having the section of a true circular section and if the second foaming nozzle 20 is removably attached to the first foaming nozzle 8, the injection liquid can be advantageously injected in the foam cluster having the sectional shape of a true circle or in the mist-foam mixed cluster having another shape such as a transversely elongated band, if necessary.

What is claimed is:

1. A spin spray nozzle and a coaxially mounted foaming nozzle of a sprayer, said foaming nozzle comprising a foaming cylinder through which a mist is capable of being spin-sprayed from a spray port in said spin spray nozzle in a shape of a hollow cone, said foaming cylinder having an elliptical section with longer and shorter diameters, including a pair of longer diameter sides located at opposed ends of said longer diameter and a pair of shorter diameter sides located at opposed ends of said shorter diameter;

wherein a denser ring-shaped mist portion at an outer circumference of the mist impinges in its substantial entirety upon said shorter diameter sides and passes in its substantial entirety over said longer diameter sides while coming close to but not impinging upon said longer diameter sides.

2. A spin spray nozzle and a foaming nozzle according to claim 1, wherein a pair of baffle plates are disposed to protrude from a middle portion of each said shorter diameter side toward the other opposing shorter diameter side, said baffle plates being separated from each other by a suitable spacing.

3. A spin spray nozzle and a foaming nozzle according to claim 2, wherein a partition plate is disposed between a middle portion of one of said two shorter diameter sides to a middle portion of the other of said two shorter diameter sides halving a nozzle port defined by an inside of said foaming cylinder.

4. A spin spray nozzle and a foaming nozzle according to claim 3, wherein arcuate recesses are formed in front end faces of said shorter diameter sides such that said denser ring-shaped mist portion impinges in its substantial entirety upon middle portions of said shorter diameter sides.

5. A spin spray nozzle and a foaming nozzle according to claim 1, wherein arcuate protrusions are disposed at front end faces of said two shorter diameter sides.

6. A spin spray nozzle and a foaming nozzle according to claim 1, wherein said shorter diameter sides have a plurality of grooves radially extending forward from a rear portion of said foaming cylinder so as to disperse said denser ring-shaped mist portion and any foam, which is formed as a result of the impingement of said denser ring-shaped mist portion upon an inner face of said foaming cylinder, substantially uniformly to a front of said foaming nozzle.

7. A spin spray nozzle and a foaming nozzle sprayer, said foaming nozzle adapted to be mounted to said spin spray nozzle of a sprayer, said foaming nozzle comprising a foaming cylinder through which a mist is capable of being spin-sprayed from a spray port in said spin spray nozzle at a constant spray angle in a shape of a hollow cone;

said foaming cylinder having a generally square section including a front face defining a square mouth with mouth sides and mouth corners such that an outer circumference of said mist impinges in its substantial entirety upon said mouth sides but passes along said mouth corners without impingement.

8. A spin spray nozzle and a foaming nozzle sprayer, said foaming nozzle adapted to be mounted to said spin spray nozzle of a sprayer, said foaming nozzle having a foaming cylinder through which a mist is capable of being spin-sprayed from a spray port in said spin spray nozzle at a constant spray angle in a shape of a hollow cone;

said foaming cylinder having a generally square section including a front face defining a square mouth with mouth sides and mouth corners, each of said mouth sides being formed with an arcuate recess between ends of the respective side;

said foaming nozzle forcing an outer circumference of said mist to impinge in its substantial entirety upon an inner face of said square mouth at said arcuate recess but allowing said mist to pass closely along said mouth corners without impingement.

9. A spin spray nozzle and a foaming nozzle sprayer, said foaming nozzle adapted to be mounted to said spin spray nozzle of a sprayer, said foaming nozzle having a foaming cylinder through which a mist is capable of being spin-sprayed from a spray port in said spin spray nozzle at a constant spray angle in a shape of a hollow cone;

said foaming cylinder having a generally rectangular section and defining at its front end a rectangular mouth with a pair of shorter sides and a pair of longer sides, each of said longer sides being formed with an arcuate recess at its front surface between both ends of said longer sides so that an outer circumference of said mist may impinge more upon inner faces of said arcuate recesses and less upon inner faces of said shorter diameter sides but pass closely along individual corners of said rectangular mouth.

10. A spin spray nozzle and a foaming nozzle sprayer, said foaming nozzle adapted to be mounted to said spin spray nozzle of a sprayer, said foaming nozzle having a foaming cylinder through which a mist is capable of being spin-sprayed from a spray port in said spin spray nozzle at a constant spray angle in a shape of a hollow cone;

said foaming cylinder having a generally triangular section and defining at its front end a triangular mouth with mouth sides and mouth corners such that an outer circumference of said mist may impinge in its substantial entirety upon said mouth sides but pass closely along said mouth corners;

said foaming cylinder being formed at said mouth sides with arcuate recesses for determining amount and range of said impingement and for diverging and emitting a cluster of said mist and foam caused by said impingement in a generally triangular sectional shape.

11. A spin spray nozzle and a foaming nozzle according to claim 10, wherein said triangular section is shaped as a right angle triangle.

12. A spin spray nozzle and a foaming nozzle according to claim 10, wherein said triangular section is shaped as an equilateral triangle.

13. A spin spray nozzle and a foaming nozzle according to claim 10, wherein said triangular section is shaped as an isosceles triangle.

14. A spin spray nozzle and a foaming nozzle sprayer, said foaming nozzle adapted to be mounted to said spin spray nozzle of a sprayer, comprising:

a first foaming cylinder having a non-circular section; and a second foaming cylinder having a circular section and hinged to said first foaming cylinder by a hinge on which said second foaming cylinder can turn, said second foaming cylinder being capable of attachment to or removal from an opening of said first foaming cylinder, wherein said second foaming cylinder is disposed such that a mist spin-sprayed from a spray port in said spin spray nozzle is injected into said second foaming cylinder through said first foaming cylinder.

* * * * *

UNITED STATES PATENT AND TRADEMARK OFFICE

CERTIFICATE OF CORRECTION

PATENT NO. : 5,344,079
DATED : September 6, 1994
INVENTOR(S) : Takaharu Tasaki; Tadao Saito It is certified that error appears in the above-indentified patent and that said Letters Patent is hereby corrected as shown below:

On title page, change "[22] Filed: May 20, 1992" to --[22] PCT Filed October 1, 1991--.

Add:

--[86] PCT No.: PCT/JP91/01321
§371 Date: May 20, 1992
§102(e) Date: May 20, 1992--

[87] PCT Pub. No.: WO92/06792
PCT PUB. Date: Apr. 30, 1992

Signed and Sealed this

Sixth Day of December, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,344,079

DATED : September 6, 1994

INVENTOR(S) : Takaharu TASAKI; Saito TADAO

It is certified that error appears in the above-indentified patent and that said Letters Patent is hereby corrected as shown below:

Column 11:

Claim 7, line 1, after "foaming nozzle" insert —of a—;
line 3, change "a" to —the—.

Column 12:

Claim 8, line 1, after "foaming nozzle" insert —of a—;
line 3, change "a" (1st occurrence) to --the--.

Column 12:

Claim 9, line 1, after "foaming nozzle" insert —of a—;
line 3, change "a" (1st occurrence) to --the--.

Column 12:

Claim 10, line 1, after "foaming nozzle" insert —of a—;
line 3, change "a" (1st occurrence) to --the--.

Column 13:

Claim 14, line 1, after "foaming nozzle" insert —of a—;
line 3, change "a" to —the—.

Signed and Sealed this

Fourteenth Day of February, 1995

*Attest:*

Bruce Lehman

BRUCE LEHMAN

*Attesting Officer*

*Commissioner of Patents and Trademarks*